US006610183B2

(12) United States Patent
Knies

(10) Patent No.: US 6,610,183 B2
(45) Date of Patent: Aug. 26, 2003

(54) METAL CATHODE SHEET ASSEMBLY

(75) Inventor: Gunter Knies, Osnabrück (DE)

(73) Assignee: KM Europa Metal AG, Osnabruck (DE)

( * ) Notice: Subject to any disclaimer, the term of this patent is extended or adjusted under 35 U.S.C. 154(b) by 62 days.

(21) Appl. No.: 10/001,151

(22) Filed: Nov. 15, 2001

(65) Prior Publication Data

US 2002/0060149 A1 May 23, 2002

(30) Foreign Application Priority Data

Nov. 17, 2000 (DE) ..... 100 57 305

(51) Int. Cl.[7] ..... C25B 9/00
(52) U.S. Cl. ..... 204/281; 204/279; 204/280
(58) Field of Search ..... 204/279, 280, 204/281

(56) References Cited

U.S. PATENT DOCUMENTS 5,314,600 A 5/1994 Webb et al. ..... 204/279
5,785,827 A * 7/1998 Dougherty ..... 204/279
5,919,343 A 7/1999 Sparapani ..... 204/286
5,928,482 A * 7/1999 Marttila ..... 204/281
6,017,429 A 1/2000 Persson ..... 204/281
6,193,862 B1 * 2/2001 Cutmore et al. ..... 204/281
6,274,012 B1 * 8/2001 Santoyo ..... 204/279
6,312,573 B1 * 11/2001 Dwyer et al. ..... 204/279
2002/0031709 A1 * 3/2002 Ebert ..... 204/279

* cited by examiner

*Primary Examiner*—Bruce F. Bell
(74) *Attorney, Agent, or Firm*—Kenyon & Kenyon

(57) ABSTRACT

The present invention relates to a metal cathode sheet assembly for use in the electrolytic recovery of pure metals, especially copper, in an electrolysis tank. The metal cathode sheet is provided at its side edges with an edge protector formed by a grooved profile strip. The edge protector is secured to the side edge by engaging at least one trapezoidal holding wedge that has back surfaces facing away from the narrow sides. The wedge is able to be secured in a cutout on the edge. The edge protector grips behind the back surface with counter-support surfaces.

7 Claims, 1 Drawing Sheet

METAL CATHODE SHEET ASSEMBLY

FIELD OF THE INVENTION

The present invention relates to a metal cathode sheet assembly having an edge protector.

BACKGROUND OF THE INVENTION

In the refinement of crude metals with the aid of electrolysis for extracting pure metal, metal is dissolved in an electrolysis tank from an impure anode and deposited in pure form on a cathode. Impurities remain dissolved in the electrolyte or form anode slime.

Various designs of electrolysis cathodes are seen among the related art. They differ mainly in the choice of materials or material combinations of the bearing rail and metal cathode sheet. The goal is to provide good electrical conductivity for minimizing energy losses, mechanical stability, and corrosion resistance.

In order to prevent the growing together of the metal layers deposited on both sides of the metal cathode sheet from reaching over the side edges, the side edges, which are vertically aligned in the electrolysis tank, are provided with an electrically insulating screen as edge protection.

In this connection, it is known to coat the side edges with wax. However, one disadvantage of using this method is that a large quantity of wax is required. Furthermore, if the wax is interspersed with contaminating particles, a bridge formation with the electrolyte can occur nonetheless, and can lead to an uncontrolled growth of metal buds. Such growth results in lower refining efficiency and can potentially disturbs the process sequence. Metal cathode sheets are therefore maintained in rotation, and the metal efflorescences are removed. This requires an operating interruption each time.

Among the related art there are solutions in which the side edges of the metal cathode sheets are provided with an edge protector of plastic.

In this connection, U.S. Pat. No. 5,919,343 describes a plastic shoulder as edge protector that is connected to the metal cathode sheet with the aid of plastic pins using fusion welding technology. Regardless, non-fused, faulty connection regions can be created, for example, by non-observance of constructive prerequisites with respect to the parts to be connected, by non-observance of certain welding parameters, and by errors in preassembly. Such faulty connections allow the passage of electrolyte and lead to uncontrolled formation of buds at the outer edge. The problem of local flux line concentration at sharp-edged borings in the metal cathode sheet, with its negative effects, has also not been solved.

Furthermore, U.S. Pat. No. 6,017,429 describes a metal cathode sheet having an electrically insulating edge protector made of plastic resistant to electrolyte. The edge profile is chemically connected to the metal cathode sheet, preferably using an adhesive or a vulcanizing technique. Again, the intimate combination of metal cathode sheet and edge profile is not absolutely ensured. Thus, with this embodiment, the infiltration by electrolyte under the wall of the edge profile can also take place.

In the metal cathode sheet known from U.S. Pat. No. 5,314,600, the edge protection is plastic rails that surround the vertical side edges of the metal cathode sheet in clamping fashion. On the side edges of the metal cathode sheet, bore holes are provided into which holding pins are fitted, by which the plastic rails are fixed. The edge protector is in loose combination with the metal cathode sheet. Thus, electrolyte can easily penetrate into the edge protector. Then, at the boring edges in the metal cathode sheet and at the inside sheet cutting edges, high local field densities can appear with the result that, particularly at these locations, uncontrolled metal growth takes place. After relatively longer-term application of the metal cathode sheet in the electrolyte, the plastic protector can be pried apart and damaged. This causes costly repair work or possibly a complete renewal of the edge protector.

SUMMARY OF THE INVENTION

It is an object of the present invention to create an improved metal cathode sheet for process applications which has an edge protector with relatively high mechanical stability and is advantageous from an application technology point of view.

Thus, in one embodiment of the invention, a metal cathode sheet assembly is provided for use in electrolytic recovery of pure metals. The assembly includes a cathode sheet having a side edge and at least one cutout through the side edge. The side edge having a narrow side. At least one trapezoidal holding wedge has back surfaces facing away from the narrow side. The holding wedge is secured to the at least one cutout, and is provided with a grooved profile. The edge protector is configured to engage the back surfaces of the holding wedge so that the edge protector is secured to the side edge of the cathode sheet.

In one embodiment of the invention, the edge protector is formed by a grooved profile strip that encapsulates the side edge. The edge protector is locked on the side edge using a fitting in of at least one trapezoid-shaped retaining wedge. For this purpose, the retaining wedge is fixed in a recess at the side of the edge, and has transversely directed back surfaces opposite the narrow sides of the metal cathode sheet.

At the edge protector provided by the present invention, there is form-locking between the metal cathode sheet and the profile strip, using a snap-fit connection that ensures firm form-locking of the two parts. The edge protector is easy to assemble and advantageous to install. Beyond that, it guarantees a great degree of imperviousness. Uncontrolled metallic efflorescences and prying apart of the edge protector are avoided. This leads to an improvement in equipment availability for the user. One can do completely without effortful and costly wax coating and decoating of the edge strips. A user's repair cycles are also substantially lengthened, and thus repair and energy costs are decreased.

It is possible to convert existing metal cathode sheets, during repair work, by exchange or conversion of the edge protection system.

Another advantage of the invention is that, when pulling out the metal cathode sheets, drag-out losses of the electrolyte are very low because of the structure of the edge protector.

Counter-support surfaces can be provided that act together with the back surfaces of the holding wedges. This measure effectively supports the form-locking snap-fit connection between profile strip and holding wedge.

Holding elements can be formed at the narrow side of the metal cathode sheet. These support the vertical fixing of the edge protector and prevent slippage. Such holding elements can be formed, for example, by a slight material clinching at the narrow sides, using a blow of the hammer or crimping.

When there are several holding wedges arranged at a distance to one another, filler strips can be arranged between them. The filler strips are preferably formed as extension of the holding wedges at a head end. The filler strips fill the space between the holding wedges, so that the disadvantageous electrolyte drag-out losses during the pulling of the metal cathode sheets can be further reduced.

It is also possible to put a longitudinal groove into the holding wedges. The spaces between the individual holding wedges can be filled up with a suitable material via the longitudinal channels. Electrolyte-resistant plastic that can be cured or ceramic substances are available as such a material.

In another advantageous embodiment, the holding wedge and the edge protector are made of an electrolyte-resistant plastic, a metallic heat conductor being integrated into the holding wedge. This measure permits an additional contactless connection between the holding wedges and the profile strip. Using a suitable heat source, especially an inductive heating device, the material of the holding wedges and of the edge protector can be partially plasticized, using the metallic heat conductor, so that they weld together with each other. A further advantage of this embodiment is that the self-locking form lock can be additionally secured without adverse influence on the edge protector as such.

DESCRIPTION OF THE PREFERRED EMBODIMENT

Figure 1:
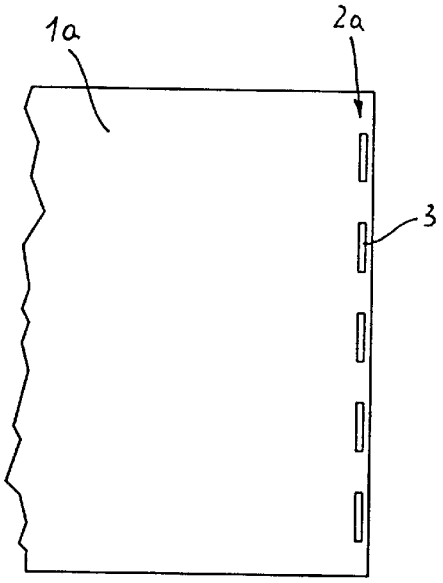
FIG. 1 is a partial view of a section of a first embodiment of a metal cathode sheet of the metal cathode sheet assembly.
Figure 2:
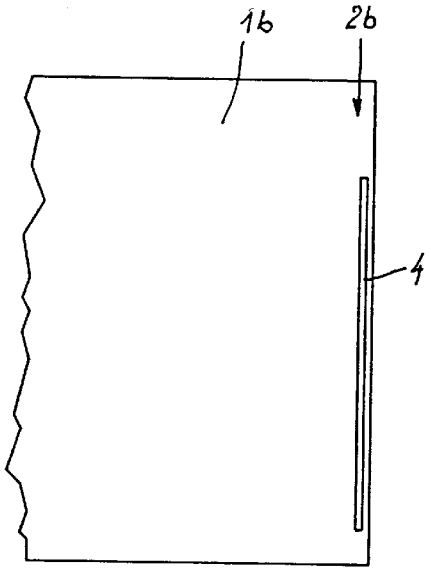
FIG. 2 is a partial view of a section of a second embodiment of a metal cathode sheet of the metal cathode sheet assembly.

In FIGS. 1 and 2, two metal cathode sheets 1*a* and 1*b* of the metal cathode sheet assembly are represented. Metal cathode sheets 1*a* and 1*b* preferably have a rectangular cross sectional configuration. In one embodiment, sheets 1*a* and 1*b* are fabricated from corrosion-resistant stainless steel. Sheets 1*a* and 1*b* can be hung on a bearing rail (not shown) made of copper and placed in an electrolysis tank (not shown here) for refining crude copper. The ends of the bearing rails are designed to reach current rails (not shown) running parallel to the electrolysis tank while making electrical contact with the installation.

As shown in FIG. 1, a plurality of short cutouts 3 are disposed on the side edge 2*a* of metal cathode sheet 1*a*. This side edge 2*a* is aligned vertically in the electrolysis tank. Instead, in another embodiment shown in FIG. 2, a relatively longer cutout 4, which forms a longitudinal slit, is disposed on the side edge 2*b* of metal cathode sheet 1*b*. Cutouts 2 and 4 accommodate holding wedges 5 (see FIGS. 3 and 4).

Figure 3:
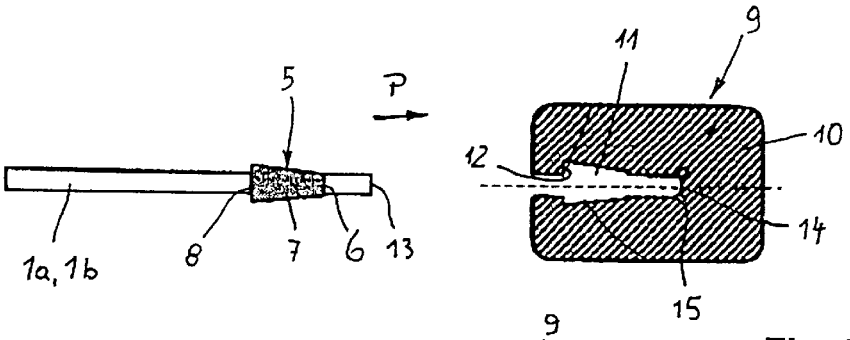
FIG. 3 is a horizontal cross section of a side edge of a metal cathode sheet assembly, the cathode sheet with a holding wedge and an edge protector prior to installation of the edge protector on the metal cathode sheet.

Holding wedge 5 shown, for example, in FIG. 3 has a trapezoidal cross section. Starting from a front face 6 of wedge 5, slanted wedge surfaces 7 extend backwards, ending to back surface 8. Installed in cutouts 3, 4, holding wedges 5 form a counter-support for an edge protector 9. Edge protector 9 consists of a grooved profile strip 10 made of plastic, which can be latched to holding wedge 5. FIG. 3 shows profile strip 10 having a longitudinal groove 11 adapted to the cross sectional configuration of side edge 2*a*, 2*b* and holding wedge 5. Metal cathode sheet 1*a*, 1*b* is inserted into a longitudinal groove 11 of protector 9 (in the direction of arrow P) until edge protector 9 engages—in a locking manner—the back surface 8 of holding wedge 5 opposite to the of narrow side 13 of metal cathode sheet 1*a* and 1*b* and aligned transversely to the plane of metal cathode sheet 1*a*, 1*b*, with its counter-support surfaces 12 formed in longitudinal groove 11. In this manner, a form-locking snap-in connection of edge protector 9 to metal cathode sheet 1*a*, 1*b* is produced to form the completed metal cathode sheet assembly shown in FIG. 4.

To avoid the formation of cracks as a result of the pull-push stress during installation of edge protector 9, at groove base 14 of profile strip 10 longitudinal cutouts 15 are provided in the corner regions.

Figure 4:
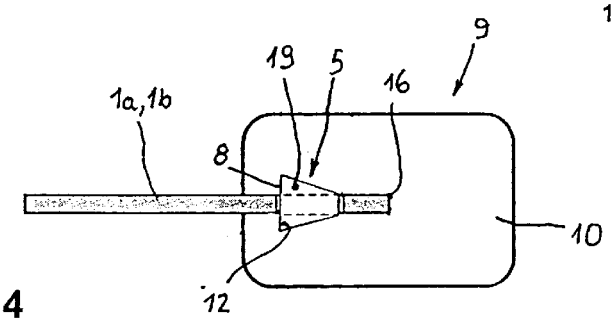
FIG. 4 is a horizontal cross section through the side edge of a metal cathode sheet assembly after installation of the edge protector on the metal cathode sheet.

At narrow side 13 of metal cathode sheet 1*a* and 1*b*, geometrical holding elements 16 can be provided. These are indicated in FIG. 4. Holding elements form a mechanical resistance and are formed at the narrow side 13 by slight material clinching. Holding elements 16 connect edge protector 9 in two planes in a form-locking and firm manner with metal cathode sheet 1*a*, 1*b*. Vertical sliding down is avoided.

Figure 5:
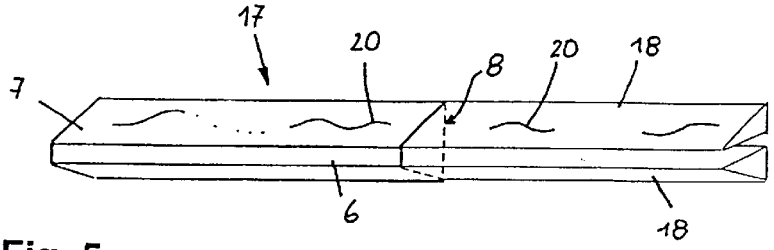
FIG. 5 is a perspective view of one embodiment of the holding wedge shown in FIGS. 3 and 4.

FIG. 5 represents a holding wedge 17 to which are joined, in its longitudinal extension, triangularly shaped filler strips 18. As for the rest, holding wedge 17 corresponds configuratively to the design of holding wedge 5 described above, so that component parts that correspond to one another are given the same reference numerals. Filler strips 18 take up the space between two holding wedges 17 arranged in a metal cathode sheet la at a distance to each other, so that the hollow space there is filled in. As a result, no electrolyte can collect here, which reduces the drag-out losses of electrolyte when the metal cathode sheets are pulled.

However, alternatively there can be a longitudinal channel 19 in holding wedges 5, as indicated in FIG. 4. Along such a longitudinal channel 19, a filler substance such as a curable plastic or a ceramic substance can be brought into the spaces present between two holding wedges 5, so that these are completely filled up.

In addition, in another embodiment, a metallic heat conductor 20 is disposed on holding wedge 17 as shown in FIG. 5. The metallic heat conductor 20 is also provided in filler strips 18. Holding wedge 17 and filler strips 18 are made of a thermoplastic plastic, as is the edge protector 9 that is used. Using an inductive heating device, heat conductor 20, provided in holding wedge 17 and in filler strips 18, is heated, whereby the surrounding materials of holding wedge 17, filler strips 18 and edge protector 9 are plasticized and fuse with one another. After cooling, a self-locking and fluid-tight edge protector 9 in combination with a holding wedge 17 or filler strip 18, is guaranteed.

While the foregoing description and drawings represent the preferred embodiments of the present invention, it will be apparent to whose skilled in the art that various changes and modifications may be made therein without departing from the true spirit and scope of the present invention.

What is claimed is:

1. A metal cathode sheet assembly for use in electrolytic recovery of pure metals, comprising:

a cathode sheet having a side edge and at least one cutout through the side edge, the side edge having a narrow side;

at least one trapezoidal holding wedge having back surfaces facing away from the narrow side, the holding wedge secured to the at least one cutout;

an edge protector having a grooved profile;

wherein the edge protector is configured to engage the back surfaces of the holding wedge so that the edge protector is secured to the side edge of the cathode sheet.

2. The metal cathode sheet assembly as recited in claim 1, the edge protector further comprising counter-support surfaces that act with the back surfaces to secure the edge protector.

3. The metal cathode sheet assembly as recited in claim 1, further comprising holding elements formed on the narrow side of the side edge.

4. The metal cathode sheet assembly as recited in claim 1, further comprising filler strips arranged between two holding wedges arranged at a distance to each other.

5. The metal cathode sheet assembly as recited in claim 1, wherein the at least one holding wedge has a longitudinal channel.

6. The metal cathode sheet assembly as recited in claim 1, wherein the at least one holding wedge and the edge protector are fabricated from a plastic resistant to electrolyte.

7. The metal cathode sheet assembly as recited in claim 1, wherein a metallic heat conductor is integrated into the holding wedge.

* * * * *